US010539323B2

(12) United States Patent
Shiba et al.

(10) Patent No.: US 10,539,323 B2
(45) Date of Patent: Jan. 21, 2020

(54) VENTURI NOZZLE AND FUEL SUPPLY DEVICE COMPRISING VENTURI NOZZLE FOR CONTROLLING A RATIO BETWEEN A FUEL GAS AND AN AIR FLOW

(71) Applicant: MIURA CO., LTD., Matsuyama-shi, Ehime-ken (JP)

(72) Inventors: Makoto Shiba, Matsuyama (JP); Shigehiro Watanabe, Matsuyama (JP); Tatsuya Fujiwara, Matsuyama (JP)

(73) Assignee: MIURA CO., LTD., Mastuyama-Shi, Ehime (JP)

( * ) Notice: Subject to any disclaimer, the term of this patent is extended or adjusted under 35 U.S.C. 154(b) by 0 days.

(21) Appl. No.: 16/070,480

(22) PCT Filed: Oct. 27, 2016

(86) PCT No.: PCT/JP2016/081836
§ 371 (c)(1),
(2) Date: Jul. 16, 2018

(87) PCT Pub. No.: WO2017/158904
PCT Pub. Date: Sep. 21, 2017

(65) Prior Publication Data

US 2019/0017700 A1 Jan. 17, 2019

(30) Foreign Application Priority Data

Mar. 18, 2016 (JP) ..... 2016-055802

(51) Int. Cl.
*F23D 14/64* (2006.01)
*F23D 14/58* (2006.01)
*F23K 5/00* (2006.01)

(52) U.S. Cl.
CPC ..... *F23D 14/64* (2013.01); *F23D 14/58* (2013.01); *F23K 5/00* (2013.01); *F23D 2203/007* (2013.01); *F23K 5/007* (2013.01)

(58) Field of Classification Search
CPC ..... F23D 14/64; F23D 14/58; F23D 14/62; F23D 2203/007; F23K 5/007
See application file for complete search history.

(56) References Cited

U.S. PATENT DOCUMENTS 3,901,445 A * 8/1975 Chang ..... C21C 5/4606 239/132.3
4,137,992 A * 2/1979 Herman ..... F02K 1/827 181/213

(Continued)

FOREIGN PATENT DOCUMENTS

JP 2-65122 U1 5/1990
JP 10-89628 A 4/1998

(Continued)

OTHER PUBLICATIONS

ISR for PCT/JP2016/081836 dated Jan. 10, 2017.

*Primary Examiner* — Imran Akram
(74) *Attorney, Agent, or Firm* — Ken I. Yoshida

(57) ABSTRACT

A venturi nozzle (1), disposed upstream from a blower (20), for mixing combustion air and fuel gas by intake pressure of the blower (20), comprising: a nozzle portion (12) with a shape that is narrowed in diameter downstream and into which combustion air is introduced; a mixing portion (13), disposed downstream from the nozzle portion (12), with a shape that is enlarged in diameter downstream and into which combustion air and fuel gas are mixed; and a fuel gas inlet (15), disposed between the nozzle portion (12) and the mixing portion (13), into which fuel gas is introduced; wherein a plurality of ridges (16) extending in a circumferential direction and arranged at predetermined intervals in a (Continued)

flow direction of combustion air are formed on an inner surface of the nozzle portion (12).

11 Claims, 6 Drawing Sheets

(56) References Cited

U.S. PATENT DOCUMENTS 4,288,984 A * 9/1981 Bhat ..... F02K 1/44 60/226.1
4,337,899 A * 7/1982 Selberg ..... B05B 1/34 239/543
4,762,530 A * 8/1988 Koziol ..... A47J 37/0713 126/41 R
6,192,911 B1 * 2/2001 Barnes ..... B01F 5/0428 137/12
9,114,367 B1 * 8/2015 Thomas ..... B01F 5/0426
2002/0063170 A1 * 5/2002 Pein ..... A61B 17/3203 239/483
2004/0190368 A1 * 9/2004 Allen ..... B01F 5/0475 366/152.1
2006/0242944 A1 * 11/2006 Anderson ..... F02K 1/386 60/262
2009/0019857 A1 * 1/2009 Tisdale ..... F02K 1/386 60/770
2009/0050710 A1 * 2/2009 Myers ..... F23D 11/38 239/132.5
2011/0232289 A1 * 9/2011 Colmegna ..... F23D 14/22 60/748
2013/0047619 A1 * 2/2013 Boardman ..... F23R 3/12 60/748
2013/0104552 A1 * 5/2013 Uhm ..... F23R 3/002 60/738
2013/0334340 A1 * 12/2013 Walker ..... B05B 3/0486 239/222.15
2014/0202443 A1 7/2014 Sherrow et al.
2015/0000285 A1 * 1/2015 Deiss ..... F02C 7/22 60/740
2015/0048177 A1 * 2/2015 Akatsuka ..... F02K 1/08 239/11
2015/0129615 A1 * 5/2015 Bates ..... B65D 81/325 222/145.5
2018/0043767 A1 * 2/2018 Zitkovic, Jr. ..... B60K 15/0406

FOREIGN PATENT DOCUMENTS

JP 2001-526372 A 12/2001
JP 2008-500533 A 1/2008
JP 2015-210042 A 11/2015

* cited by examiner

VENTURI NOZZLE AND FUEL SUPPLY DEVICE COMPRISING VENTURI NOZZLE FOR CONTROLLING A RATIO BETWEEN A FUEL GAS AND AN AIR FLOW

TECHNICAL FIELD

The present invention relates to a venturi nozzle and a fuel supply device having the venturi nozzle. This application claims priority based on Japanese Patent Application No. 2016-055802, filed on Mar. 18, 2016, the contents of which are incorporated herein by reference.

BACKGROUND ART

A preliminarily mixing burner, of a fan-suction mixing system, in which combustion air and fuel gas are mixed upstream from a blower for feeding combustion air into a combustion device is known as a fuel supply device used in a combustion device such as a steam boiler for heating water to generate steam by mixing fuel gas with combustion air and combusting the fuel gas (for example, refer to Patent Document 1).

CITATION LIST

Patent Literature

Patent Document 1: Japanese Patent Application Laid-Open No. 2001-526372

SUMMARY OF INVENTION

Technical Problem

The preliminarily mixing burner, of the fan-suction mixing system, includes a blower and a venturi nozzle disposed upstream from the blower. The venturi nozzle includes a nozzle portion, having a shape that is narrowed in diameter to downstream, into which combustion air is introduced; a mixing portion, disposed downstream from the nozzle portion, in which combustion air and fuel gas are mixed; and a fuel gas inlet, disposed between the nozzle portion and the mixing portion, into which fuel gas is introduced.

Using the above venturi nozzle, combustion air is drawn into the nozzle portion by driving the blower, and fuel gas is drawn into the mixing portion from the fuel gas inlet by the venturi effect of combustion air drawn into the nozzle portion. By configuring the preliminarily mixing burner to include the venturi nozzle in this manner, fuel gas is efficiently mixed with combustion air by utilizing the venturi effect so that fuel gas and combustion air are favorably mixed without increasing the supply pressure of fuel gas to the fuel supply device.

However, in the preliminarily mixing burner of the fan-suction mixing system, it is difficult to keep the mixing ratio (i.e., the air ratio) of fuel gas and combustion air constant when the amount of combustion is changed by changing the output of the blower. In other words, compared to the case in which the output of the blower is large (i.e., when the flow rate of combustion air is large), the influence of boundary layer separation on the surface of the venturi nozzle becomes large when the output of the blower is small (i.e., when the flow rate of combustion air is small), and the flow coefficient of combustion air introduced into the venturi nozzle decreases. In the venturi nozzle, since the air ratio is kept constant by keeping the supply pressure of combustion air (i.e., atmospheric pressure) and the supply pressure of fuel gas in a certain relationship, the air ratio cannot be kept constant if the flow coefficient changes. Therefore, in the conventional fuel supply device, a gas pressure adjusting mechanism, which adjusts the supply pressure of fuel gas in accordance with changes in the flow coefficient caused by changes in combustion amount (i.e., changes in the supplied amount of combustion air), is required.

Accordingly, it is an object of the present invention to provide a venturi nozzle with a simpler configuration, capable of maintaining a constant flow coefficient even when the flow rate of combustion air fluctuates, and a fuel supply device including the venturi nozzle.

Solution to Problem

The present invention relates to a venturi nozzle, being disposed upstream from a blower, which is configured to mix combustion air and fuel gas by intake pressure of the blower, comprising: a nozzle portion with a shape that is narrowed in diameter to downstream and into which combustion air is introduced; a mixing portion, being disposed downstream from the nozzle portion, with a shape that is enlarged in diameter to downstream and into which the combustion air and the fuel gas are mixed; and a fuel gas inlet disposed between the nozzle portion and the mixing portion and into which the fuel gas is introduced, and a plurality of grooves or ridges, being disposed on an inner surface of the nozzle portion, which extend in a circumferential direction of the inner surface of the nozzle portion, and are arranged at predetermined intervals in a flow direction of the combustion air.

Further, it is preferable that the inner surface of the nozzle portion has a surface that is curved convexly inside the nozzle portion.

Further, it is preferable that the height (h) of the grooves or ridges is 0.5 mm to 5 mm, and the ratio (l/h) of the distance (l) between adjacent grooves or ridges to the height (h) of the grooves or ridges is within a range from 1 to 5.

Further, it is preferable that, among the surfaces constituting the ridges, the surfaces faced to the central axis side of the nozzle portion extend parallel to the central axis or perpendicular to the central axis, or diverge from the central axis in the upstream direction, while, among the surfaces constituting the ridges, the surfaces faced to the outer surface side of the nozzle portion extend parallel to the central axis or perpendicular to the central axis, or approach to the central axis in the upstream direction.

Further, for the venturi nozzle, the ratio of the flow coefficient, when the Reynolds number is 1.0E+5, to the flow coefficient, when the Reynolds number is 2.5E+5, may be preferably 0.97 to 1.00.

Still further, for the venturi nozzle, the ratio of the flow coefficient, when the Reynolds number is 5.0E+4, to the flow coefficient, when the Reynolds number is 2.5E+5, may be preferably 0.94 to 1.00.

The present invention relates to a fuel supply device including the venturi nozzles described above, a blower disposed downstream from the venturi nozzle, and a controller for controlling the output of the blower.

Advantageous Effect of Invention

According to the present invention, it is possible to provide a venturi nozzle with a simpler configuration, capable of maintaining a constant flow coefficient even when the flow rate of combustion air fluctuates, and a fuel supply device including the venturi nozzle.

DESCRIPTION OF EMBODIMENTS

Figure 1:
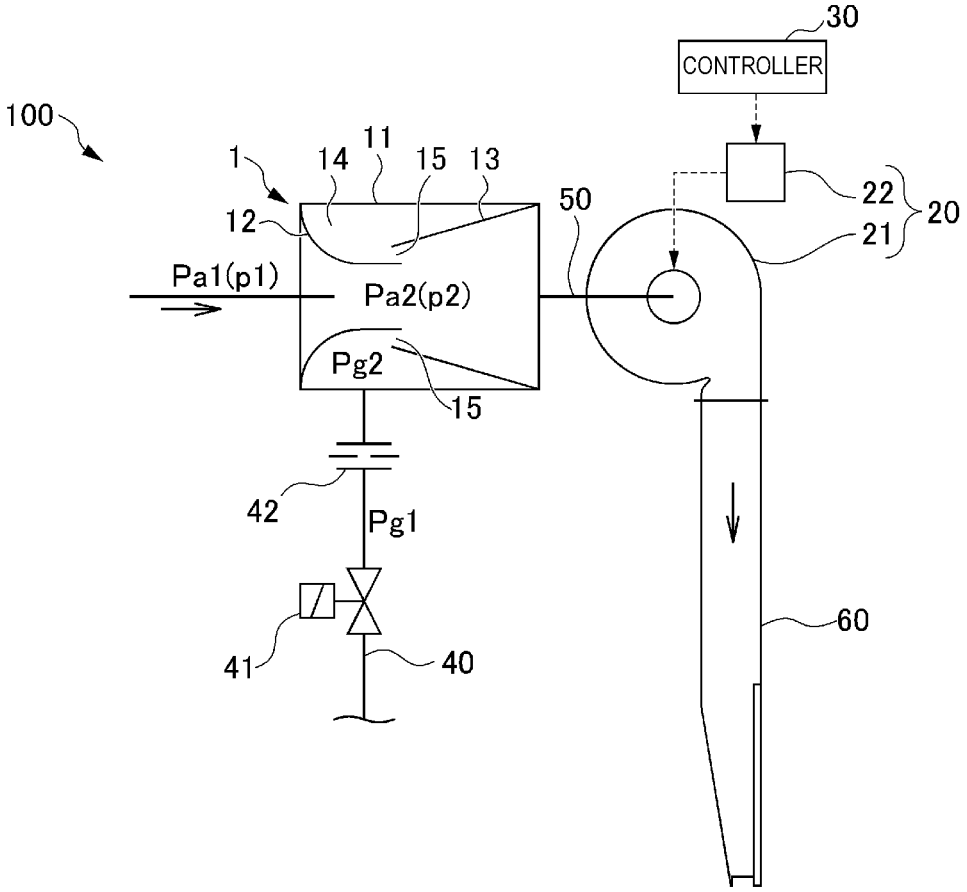
FIG. 1 is a diagram schematically showing a configuration of a fuel supply device of the present invention.

Hereinafter, preferred embodiments of a venturi nozzle and a fuel supply device of the present invention will be described with reference to the drawings. The fuel supply device 100 of the present embodiment is a preliminarily mixing burner of a fan-suction mixing system that mixes combustion air and fuel gas on the upstream side of the blower, and supplies a mixture of the combustion air and the fuel gas to a combustion device such as a steam boiler (not shown). The fuel supply device 100 has a blower 20, a controller 30, a venturi nozzle 1, a fuel gas supply line 40, a first air-fuel mixture supply line 50, and a second air-fuel mixture supply line 60.

The blower 20 has a blower main body 21 having a fan and a motor for rotating the fan, and an inverter 22 for increasing or decreasing the rotational speed of the fan (i.e., motor). In the blower 20, the fan rotates at a predetermined rotational speed according to a frequency input to the inverter 22 thereby sucking combustion air and fuel gas at a predetermined output and feeding them to the combustion device.

The controller 30 changes the output of the blower 20 according to the combustion state of the combustion device (e.g., the combustion position of a steam boiler) and controls the flow rate of combustion air supplied to the combustion device. Specifically, when the combustion device is combusted at a high combustion position, the output of the blower 20 is set higher than the output of the blower 20 when the combustion device is combusted at a low combustion position.

The venturi nozzle 1 is disposed upstream of the blower 20. The venturi nozzle 1 has a casing 11, a nozzle portion 12, a mixing portion 13, a fuel gas flow path 14, and a fuel gas inlet 15. The casing 11 has a cylindrical shape open on both ends, both ends being composed of metal members, for example, of aluminum or stainless steel. The casing 11 constitutes the outer shape of the venturi nozzle 1.

The nozzle portion 12 is disposed inside the casing 11. More specifically, the nozzle portion 12 has a shape that is narrowed in diameter toward the downstream side, and the upstream edge of the nozzle portion 12 is joined to the upstream edge of the casing 11 over the entire circumference. The nozzle portion 12 functions as a portion into which combustion air is introduced.

Figure 2:
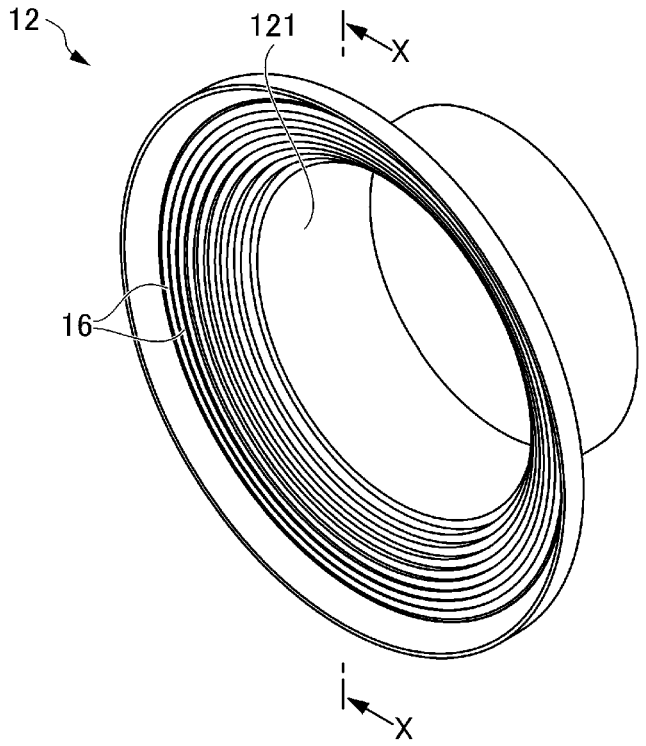
FIG. 2 is a perspective view showing a nozzle portion of a venturi nozzle according to an embodiment of the present invention.
Figure 3:
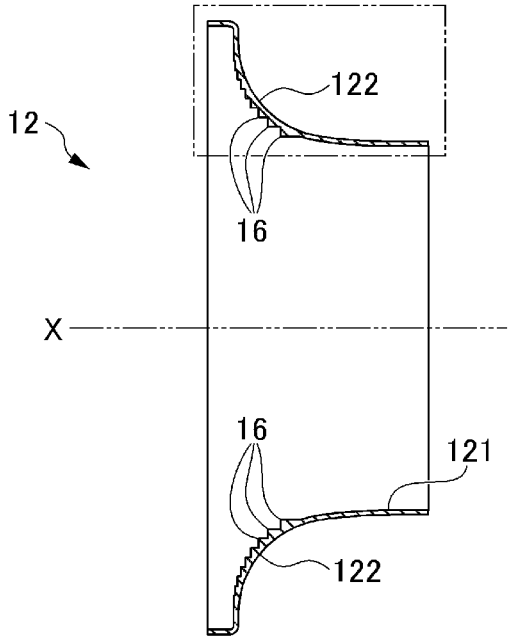
FIG. 3 is a cross-sectional view taken along the line X-X in FIG. 2.

In the present embodiment, as shown in FIGS. 2 and 3, the nozzle portion 12 has a truncated-cone shape having a curved surface curved such that the cross-sectional shape in the axial direction is convex inside the nozzle portion 12. More specifically, the inner surface of the nozzle portion 12 has a straight portion 121 disposed on the downstream end in a radial cross-sectional view and a curved quarter-circle surface portion 122 curved convexly inside the nozzle portion 12 with a predetermined radius R. As shown in FIGS. 2 and 3, a plurality of ridges 16 extending in the circumferential direction and arranged at predetermined intervals in the flow direction of the combustion air are formed on the inner surface of the nozzle portion 12. Details of the ridges 16 will be described later.

The mixing portion 13 is disposed on the downstream side of the nozzle portion 12 inside the casing 11 and has a shape with an enlarged diameter toward the downstream side. The diameter of the upstream edge of the mixing portion 13 is configured to be slightly larger than the diameter of the downstream edge of the nozzle portion 12. The upstream edge of the mixing portion 13 is disposed at a position overlapped with the downstream edge of the nozzle portion 12. The downstream edge of the mixing portion 13 is joined to the downstream edge of the casing 11 over the entire circumference. In the present embodiment, as shown in FIGS. 2 and 3, the mixing portion 13 has a truncated-cone shape. The mixing portion 13 mixes combustion air introduced from the nozzle portion 12 with fuel gas introduced from the fuel gas inlet 15 described later.

The fuel gas flow path 14 has a space enclosed by the inner surface of the casing 11, the outer surface of the nozzle portion 12, and the outer surface of the mixing portion 13. Fuel gas is supplied to the fuel gas flow path 14 from a fuel gas supply line 40 to be described later.

The fuel gas inlet 15 is disposed between the nozzle portion 12 and the mixing portion 13. Specifically, the fuel gas inlet 15 has a gap formed between the downstream edge of the nozzle portion 12 and the upstream edge of the mixing portion 13.

The fuel gas supply line 40 supplies fuel gas to the venturi nozzle 1. An upstream side of the fuel gas supply line 40 is connected to a fuel gas source (not shown). The downstream side of the fuel gas supply line 40 is connected to the casing 11. A pressure equalizing valve 41 and an orifice 42 are disposed in the fuel gas supply line 40. The orifice 42 and the pressure equalizing valve 41 reduce the pressure of the fuel gas flowing through the fuel gas supply line 40 to a set pressure and supplies the pressure to the venturi nozzle 1.

The first air-fuel mixture supply line 50 connects the venturi nozzle 1 to the blower 20. The first air-fuel mixture supply line 50 allows the air-fuel mixture of fuel gas mixed with combustion air in the mixing section 13 to flow to the blower 20 side.

The second air-fuel mixture supply line 60 connects the blower 20 to the combustion device (not shown). The second air-fuel mixture supply line 60 allows the air-fuel mixture fed into the blower 20 to flow to the combustion device side.

According to the fuel supply device 100 described above, when the blower 20 is driven at a predetermined output by the controller 30, combustion air is drawn into the nozzle portion 12, which is narrowed in diameter toward the downstream side, and is then drawn into the mixing portion 13, which is enlarged in diameter toward the downstream side. The fuel gas is supplied to the fuel gas flow path 14 from the fuel gas supply line 40 at a predetermined pressure. Then, by a venturi effect caused by combustion air being drawn into the nozzle portion 12 and further drawn into the mixing portion 13, fuel gas supplied to the fuel gas flow path 14 is drawn into the mixing portion 13 through the fuel gas inlet 15. Thus, by utilizing the venturi effect, combustion air and fuel gas are efficiently mixed in the venturi nozzle 1 without increasing the supply pressure of the fuel gas. The mixture of combustion air and fuel gas mixed in the mixing section 13 is supplied to the combustion device through the first mixture supply line 50, the blower 20, and the second air-fuel mixture supply line 60, and is combusted in the combustion device.

Ideally, in the venturi nozzle 1, the following relational expressions hold.

Fuel gas flow rate: $Qg \propto \sqrt{Pg1-Pg2}$

Air flow rate: $Qa \propto \sqrt{Pa1-Pa2}$ $Pg2=Pa2$ [Equation 1]

In addition to the above relationships, by keeping Pg1=Pa1 (i.e., Patm (atmospheric pressure)) using the pressure equalizing valve 41, the relative proportions of Qg and Qa (i.e., mixing ratio of combustion air and fuel gas) are maintained during the venturi mixing. This allows a constant air ratio to be maintained without a mechanical or electrical fuel gas pressure regulating mechanism, required by other mixing schemes, to keep the air ratio constant.

However, in the conventional preliminarily mixing burner of the fan-suction mixing system including a venturi nozzle, it was difficult to maintain a constant mixing ratio of fuel gas and combustion air (i.e., the air ratio) when the amount of combustion was changed by changing the output of the blower. That is, the influence of boundary layer separation occurring on the surface of the venturi nozzle was considered to become large when the output of the blower was small (i.e., when the flow rate of combustion air was low) compared to when the output of the blower was large (i.e., when the flow rate of combustion air was high), which turned out lowering the flow coefficient of combustion air introduced into the venturi nozzle. In the venturi nozzle, since the air ratio was kept constant by maintaining a constant relationship between the supply pressure Pa1 (i.e., atmospheric pressure) of combustion air and the supply pressure Pg1 of fuel gas, the air ratio was not kept constant when the flow coefficient changed.

Here, the flow coefficient C is expressed by the following equation. A decrease in the flow coefficient indicates an increase in the loss of flow.

$$\text{Flow coefficient } C = \frac{v2}{\sqrt{\frac{z(p1-p2)}{\rho} + v1^2}} \quad \text{[Equation 2]}$$

where v is the flow rate, p is the pressure, and p is the density. The subscript 2 indicates a value at the narrowest part of the nozzle (corresponding to the position of Pa2 in FIG. 1), and the subscript 1 indicates a value at the nozzle inlet (corresponding to the position of Pa1 in FIG. 1).

In the present embodiment, the venturi nozzle 1 has a plurality of ridges 16 on the inner surface of the nozzle portion 12. As a result, turbulence is created on the surface of the nozzle portion 12 by the plurality of ridges 16 on the nozzle portion 12 so that boundary layer separations can be suppressed. Therefore, in cases where the flow rate of combustion air is small or large, pressure fluctuations of the combustion air introduced into the venturi nozzle 1 can be suppressed so that the flow coefficient C is stabilized even when the flow rate of the combustion air fluctuates, thereby keeping the air ratio constant.

Figure 4:
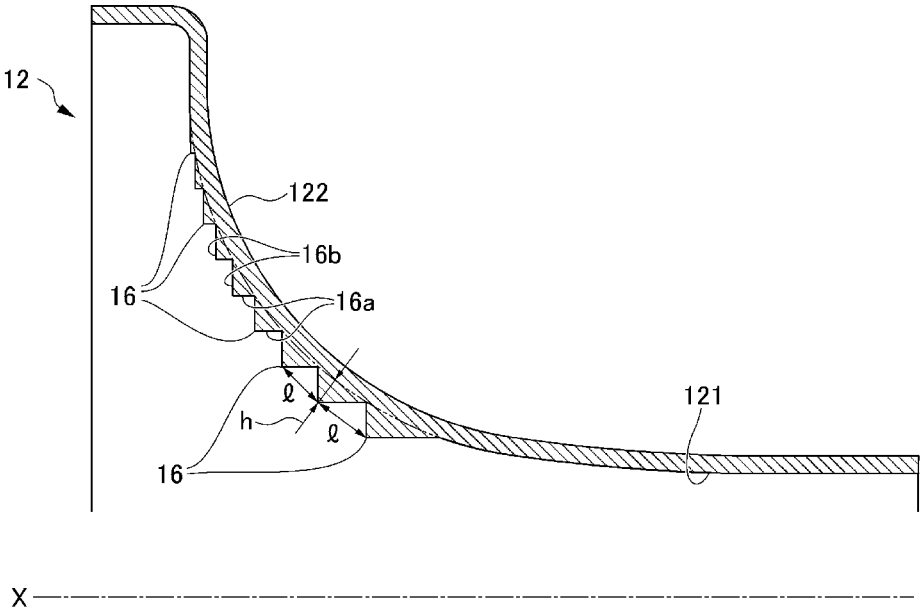
FIG. 4 is an enlarged view of a portion of FIG. 3.

In the present embodiment, as shown in FIGS. 3 and 4, the ridges 16 are annularly formed on the inner surface of the nozzle portion 12 so as to extend over the entire circumference in the circumferential direction. Further, the annular ridges 16 are arranged at predetermined intervals in the flow direction of the combustion air on the curved surface portion 122 of the nozzle portion 12.

More specifically, in the present embodiment, the ridges 16 are formed so as to protrude inward from the inner surface of the curved surface portion 122 of the nozzle portion 12. The heights (h) of the plurality of ridges 16 gradually increase from the upstream side toward the downstream side. The apexes of the plurality of ridges 16 each have an angle of approximately 90 degrees and the plurality of ridges 16 form a staircase-shape.

Among the surfaces constituting the ridges 16, the surfaces faced to the central X-axis side of the nozzle portion 12 (i.e., the surfaces 16*a* in FIG. 4) extend parallel to the central axis or perpendicular to the central axis, or diverge from the central X-axis in the upstream direction. In the present embodiment, among the surfaces constituting the ridges 16, the surfaces 16*a* which face the central X-axis of the nozzle portion 12 extend parallel to the central X-axis.

Further, among the surfaces constituting the ridges 16, the surfaces faced to the outer surface of the nozzle portion 12 extend parallel to the central X-axis or perpendicular to the central X-axis, or approach to the central axis in the upstream direction. In the present embodiment, among the surfaces constituting the ridges 16, the surfaces 16*b* faced to the outer surface side of the nozzle portion 12 extend perpendicularly to the central X-axis. Consequently, when the nozzle portion 12 is formed using a mold, the ridges 16 can be optimally formed.

Referring to FIG. 4, in order to effectively suppress the decrease in the flow coefficient C at a low flow rate while reducing the pressure loss, it is preferable for the height (h) of the ridges 16 in the nozzle portion 12 to be 0.5 mm to 5 mm. If the height (h) of the ridges 16 is too large, pressure loss due to the positioning of the ridges 16 becomes too large. Further, if the height (h) of the ridges 16 is too small, not enough turbulence is generated by the ridges 16 and boundary layer separation cannot be sufficiently suppressed.

From the same perspective, referring to FIG. 4, it is also preferable that the ratio (l/h) of the distance (l) between adjacent ridges 16 to the height (h) of the ridge 16 is within a range from 1 to 5. When the ratio (l/h) of the distance (l) between ridges 16 (i.e., the distance (l) between adjacent ridges 16) to the height (h) of the ridge 16 is too large, suppression of boundary layer separation by the plurality of ridges 16 deteriorates.

In the present embodiment, the height (h) of the ridge 16 refers to the distance in the vertical direction from the top of the ridge 16 to the curved surface portion 122 of the nozzle portion 12 as shown in FIG. 4. The distance (l) between adjacent ridges 16 refers to the linear distance between the apexes of adjacent ridges 16.

Further, when the venturi nozzle 1 of the present embodiment is applied to a combustion device (e.g., a steam boiler having a large turndown ratio) that greatly changes the output of the blower, in order to suppress variations in air ratio with high or low flow rates, it is preferable that the ratio (C2/C1) of the flow coefficient C2, when the Reynolds number is 1.0E+5, to the flow coefficient C1, when the Reynolds number is 2.5E+5, may be 0.97 to 1.00. From the same perspective, it is also preferable that the ratio (C3/C1) of the flow coefficient C3, when the Reynolds number is 5.0E+4, to the flow coefficient C1, when the Reynolds number is 2.5E+5, may be 0.94 to 1.00, and more preferably 0.97 to 1.00.

EMBODIMENTS AND COMPARATIVE EXAMPLES

Next, the present invention will be described in more detail with an embodiment and comparative examples, but the present invention is not limited thereto.

[Measurement of Flow Coefficient]

The flow coefficient of the inlet of the nozzle portion at each flow rate is measured by changing the flow rates of the combustion air for the venturi nozzle 1 of Example 1, the venturi nozzle having a nozzle portion 12 with a plurality of ridges 16 on the inner surface thereof, and the venturi nozzles of Comparative Examples 1 and 2 having nozzle portions 120 without ridges.

Comparative Example 1

Figure 5:
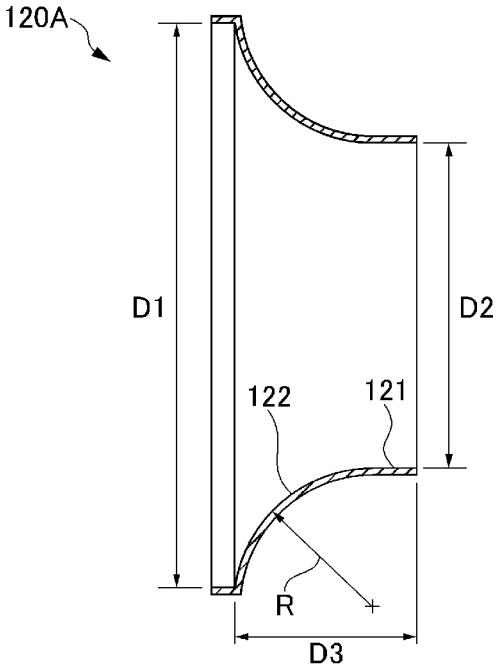
FIG. 5 is a cross-sectional view showing a nozzle portion of a venturi nozzle of Comparative Example 1, corresponding to FIG. 3.

Now referring to FIG. 5, a venturi nozzle of a comparative example is manufactured using a nozzle portion 120A without the dimples or ridges. The flow rate of combustion air is varied, and the flow coefficient is measured at each flow rate. The nozzle portion 120A has a diameter D1 of the upstream edge that is about 1.75 times the diameter D2 of the downstream edge, an inner surface having a straight portion 121 on the downstream end in a radial cross-sectional view, and a curved quarter-circle surface portion 122 bent so as to be convex inside the nozzle portion 120A with a radius R that is about 0.4 times the diameter D2 of the downstream edge. The length D3 of the nozzle portion 120A is about 0.5 times the diameter D2 of the downstream edge.

Embodiment 1

For the venturi nozzle 1 using the nozzle portion 12 of the Embodiment 1 shown in FIGS. 2 to 4, the flow rate of the combustion air is varied, and the flow coefficient is measured at each flow rate. The nozzle portion 12 of Embodiment 1 is manufactured using the same nozzle portion as that of Comparative Example 1 and forming a plurality of ridges 16 on the curved surface portion 122 of the inner surface of the nozzle portion 12.

The ridges 16 of the Embodiment 1 are formed so that the height (h) of the most upstream ridge 16 is 0.5 mm and the height (h) of the most downstream ridge 16 on the most downstream edge is 1.7 mm. The ratio (l/h) of the distance (l) between the adjacent ridges 16 to the height (h) of the ridges 16 is 2 at the most upstream end and 4 at the most downstream end.

Comparative Example 2

Figure 6:
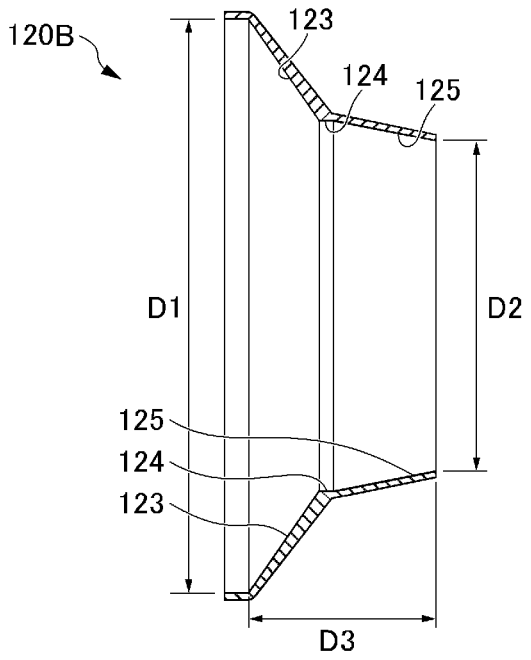
FIG. 6 is a cross-sectional view showing a nozzle portion of a venturi nozzle of Comparative Example 2, corresponding to FIG. 3.

For the venturi nozzle using the nozzle portion 120B of Comparative Example 2 as shown in FIG. 6, the flow rate of the combustion air is varied, and the flow coefficient is measured at each flow rate. The nozzle portion 120B of Comparative Example 2 has a diameter D1 at the upstream edge, a diameter D2 at the downstream edge, and a length D3 which are the same as the corresponding dimensions in Example 1 but has a plurality of discontinuous inner surfaces having a first straight portion 123, a second straight portion 124, and a third straight portion 125 from the upstream edge in a radial cross-sectional view.

Figure 7:
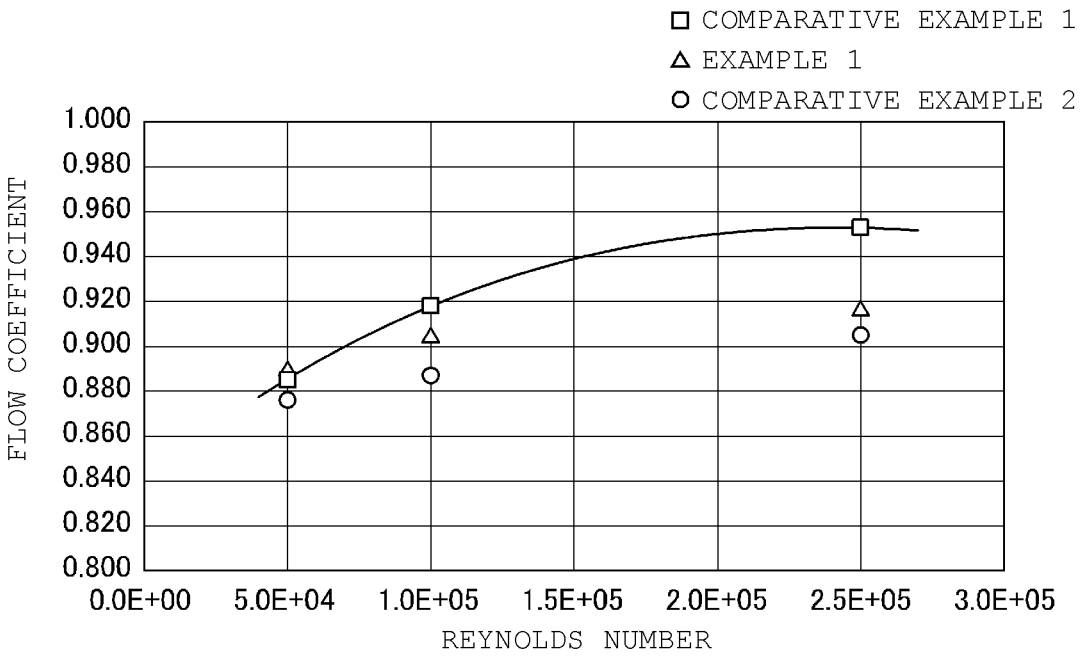
FIG. 7 is a diagram showing results with the present embodiment and the comparative examples.

The results of the above-mentioned Embodiment 1 and Comparative Examples 1 and 2 are shown in FIG. 7 and Table 1.

TABLE 1

| | Comparative Example 1 (Reference nozzle) | Embodiment 1 | Comparative Example 2 |
|---|---|---|---|
| Flow coefficient C1 Re = 2.5E+05 | 0.953 | 0.917 | 0.905 |
| Ratio of C1 to C1 of reference nozzle | | 96.2% | 95.0% |
| Flow coefficient C2 Re = 1.0E+05 | 0.918 | 0.905 | 0.887 |
| Decrease in flow coefficient (C2/C1) | 96.3% | 98.7% | 98.0% |
| Flow coefficient C3 Re = 5.0E+04 | 0.885 | 0.890 | 0.876 |
| Decrease in flow coefficient (C3/C1) | 92.9% | 97.1% | 96.8% |
| Notes | | Decrease in flow coefficient is suppressed in the low Re region with small increase in nozzle resistance. | Decrease in flow coefficient is suppressed, but nozzle resistance is large. |

As shown in FIG. 7 and Table 1, it is confirmed that in the venturi nozzle of Embodiment 1 in which a plurality of ridges 16 are formed on the inner surface of the nozzle portion 12, the tendency of the flow coefficient to decrease at a low flow rate (i.e., low Reynolds number) is smaller than that of the venturi nozzle of Comparative Example 1 in which a plurality of ridges 16 are not formed.

More specifically, in the venturi nozzle of Embodiment 1, the ratio (C2/C1) of the flow coefficient C2, when the Reynolds number is 1.0E+5, to the flow coefficient C1, when the Reynolds number is 2.5E+5, is maintained at 0.98 or more, and it is confirmed that the decreasing tendency of the flow coefficient C in the low flow rate range is suppressed. By suppressing the rate of change in the flow coefficient C in the range of Reynolds number 2.5E+5 to 1.0E+5, a stable combustion state can be achieved even, for example, when the venturi nozzle is applied to a combustion device that greatly changes the output of a blower (e.g., a steam boiler having a large turndown ratio).

On the other hand, in the venturi nozzle of Comparative Example 2 using the nozzle portion 120 having a plurality of discontinuous inner surfaces, as shown in FIG. 7 and Table 1, variation in flow coefficient with variation in flow rate is reduced, but it is confirmed that flow coefficient decreased as a whole compared with the venturi nozzles with a nozzle portion 12 having a curved quarter-circle surface. The results showed that the venturi nozzle of Comparative Example 2 has a larger loss than the venturi nozzle of Embodiment 1.

From the above results, it is shown that in the venturi nozzle of Embodiment 1 having the nozzle portion 12 with a plurality of ridges 16 on the inner surface, the flow coefficient is kept constant when the flow rate is varied. Further, it is shown that by making the inner surface of the nozzle portion 12*a* curved surface, it is possible to stabilize the flow coefficient while maintaining a high flow coefficient.

With the venturi nozzle 1 and the fuel supply device 100 of the present embodiment described above, the following effects are achieved.

(1) When a fuel supply device capable of handling variations in combustion amount includes a venturi nozzle and a blower disposed downstream from the venturi nozzle, it was difficult to keep the air ratio (i.e., mixing ratio of fuel gas to combustion air) constant, when the output of the blower was increased to increase the flow rate of fuel gas and combustion air to be supplied (i.e., to increase the amount of combustion), and when the output of the blower was decreased to decrease the flow rate of fuel gas and combustion air to be supplied (i.e., to reduce the amount of combustion). In other words, compared to the case in which the output of the blower was large (i.e., when the flow rate of combustion air was large), the influence of boundary layer separation on the surface of the venturi nozzle became large when the output of the blower was small (i.e., when the flow rate of combustion air was small), and the flow coefficient of combustion air introduced into the venturi nozzle decreased. Therefore, in the conventional fuel supply device, a gas pressure adjusting mechanism, which adjusts the supply pressure of fuel gas in accordance with changes in the flow coefficient caused by changes in combustion amount (i.e., changes in the supplied amount of combustion air), was required. However, the venturi nozzle 1 is configured by forming a plurality of ridges 16 on the inner surface of the nozzle portion 12 and the fuel supply device 100 is configured with this venturi nozzle 1 included. As a result, turbulence is generated on the surface of the nozzle portion 12 by the plurality of ridges 16 formed in the nozzle portion 12 and boundary layer separations are suppressed, thereby suppressing a decrease in the flow coefficient when the flow rate of combustion air is small. Therefore, since the flow coefficient in the venturi nozzle 1 is kept constant even when the flow rate of combustion air changes, the mixing ratio of combustion air to fuel gas (i.e., the air ratio) is kept constant even when the flow rate of the combustion air fluctuates. As a result, even in a boiler with a large turndown ratio, the boiler can be configured without a gas pressure adjusting mechanism or the like associated with variations in combustion amount so that manufacturing costs for a fuel supply device 100 that includes the venturi nozzle 1, and a boiler that includes this fuel supply device 100, can be reduced. Further, since the mixing ratio of combustion air and fuel gas (i.e., the air ratio) is kept constant, even when the fuel supply device includes a gas pressure adjusting mechanism, dependence on the gas pressure adjusting mechanism is reduced and the air ratio is stabilized by a simpler control mechanism.

(2) The inner surface of the nozzle portion 12 is constituted by a curved surface curved so as to be convex inside the nozzle portion 12. As a result, the flow coefficient is stabilized while maintaining a high flow coefficient. Therefore, since the pressure loss in the venturi nozzle 1 is reduced, the load of the blower 20 can be reduced, and suppression of energy loss and stabilization of the flow rate characteristic can be achieved at the same time.

Figure 8:
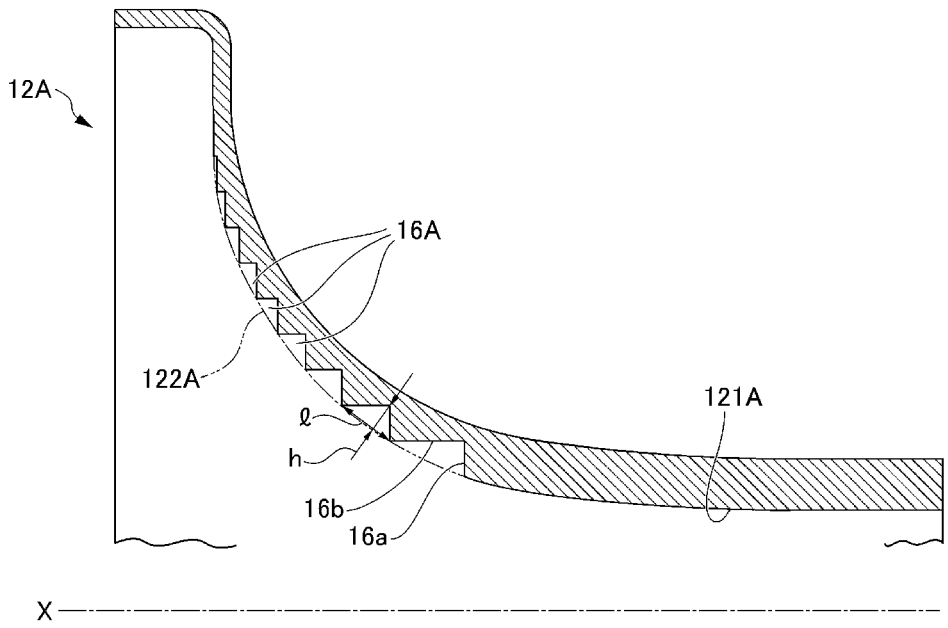
FIG. 8 is a cross-sectional view showing a nozzle portion of a venturi nozzle according to a first modification of the present invention, and is a view corresponding to FIG. 4.

Although preferred a embodiment of the venturi nozzle and the fuel supply device of the present invention are described above, the present invention is not limited to the above-described embodiment and can be modified as appropriate. For example, in the present embodiment, the venturi nozzle 1 is configured by forming a plurality of ridges 16 having shapes protruding from the inner surface of the curved surface portion 122 of the nozzle portion 12. That is, as shown in FIG. 8, a venturi nozzle may be configured by forming a plurality of grooves 16A recessed from the inner surface of the curved surface portion 122A of the nozzle portion 12A. In this case, the height (h) of the groove 16A refers to the distance in the vertical direction from the innermost portion of the groove 16A to the inner surface of the curved surface portion 122 of the nozzle portion 12. The distance (l) between adjacent grooves 16A refers to the linear distance between the skirt portions (i.e., the most inwardly diposed portions) of adjacent grooves 16A. In this case, among the surfaces constituting the grooves 16A, the surfaces 16*a* faced to the central X-axis side of the nozzle portion 12A extend perpendicularly to the central X-axis. Among the surfaces constituting the grooves 16A, the surfaces 16*b* faced to the outer surface side of the nozzle portion 12A extend parallel to the central X-axis.

Figure 9:
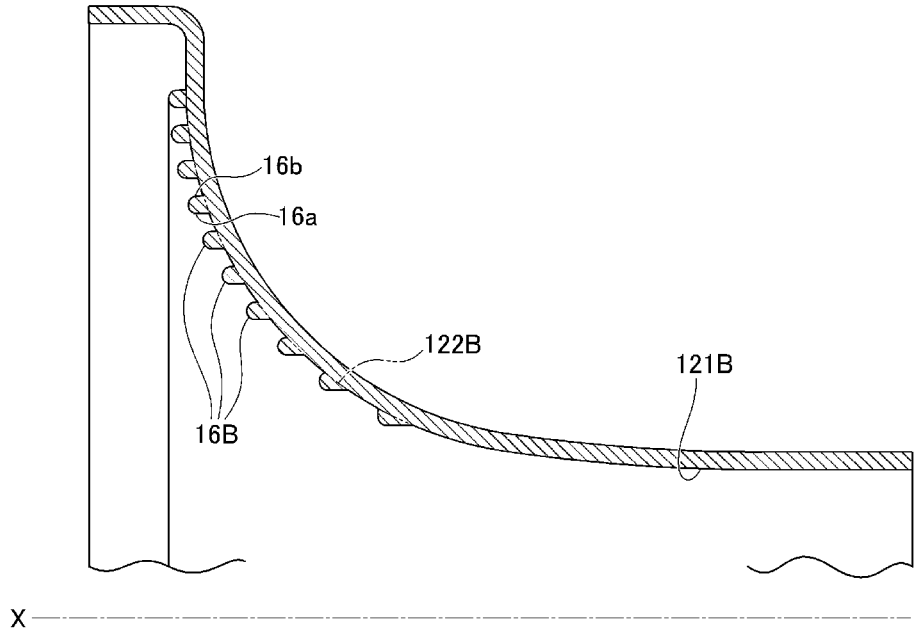
FIG. 9 is a cross-sectional view showing a nozzle portion of a venturi nozzle according to a second modification of the present invention, and is a view corresponding to FIG. 4.

Further, in the present embodiment, each of the apexes of the plurality of ridges 16 protrude from the inner surface of the nozzle portion 12 at an angle of approximately 90 degrees, and the plurality of ridges 16 form a staircase shape, but the present invention is not limited to this. That is, as shown in FIG. 9, a plurality of ridges 16B may be ribbed-shaped so that the top portions are convex and protrude from the inner surface of the curved surface portion 122B of the nozzle portion 12B. In this case, among the surfaces constituting the ridges 16B, the surfaces 16*a* faced to the central X-axis side of the nozzle portion 12B and the surfaces 16*b* faced to the outer surface side of the nozzle portion 12B, all extend parallel to the central X-axis.

Further, the height (h) of the ridges 16 and the distance (l) between adjacent ridges 16 are not limited to this embodiment.

Figure 10:
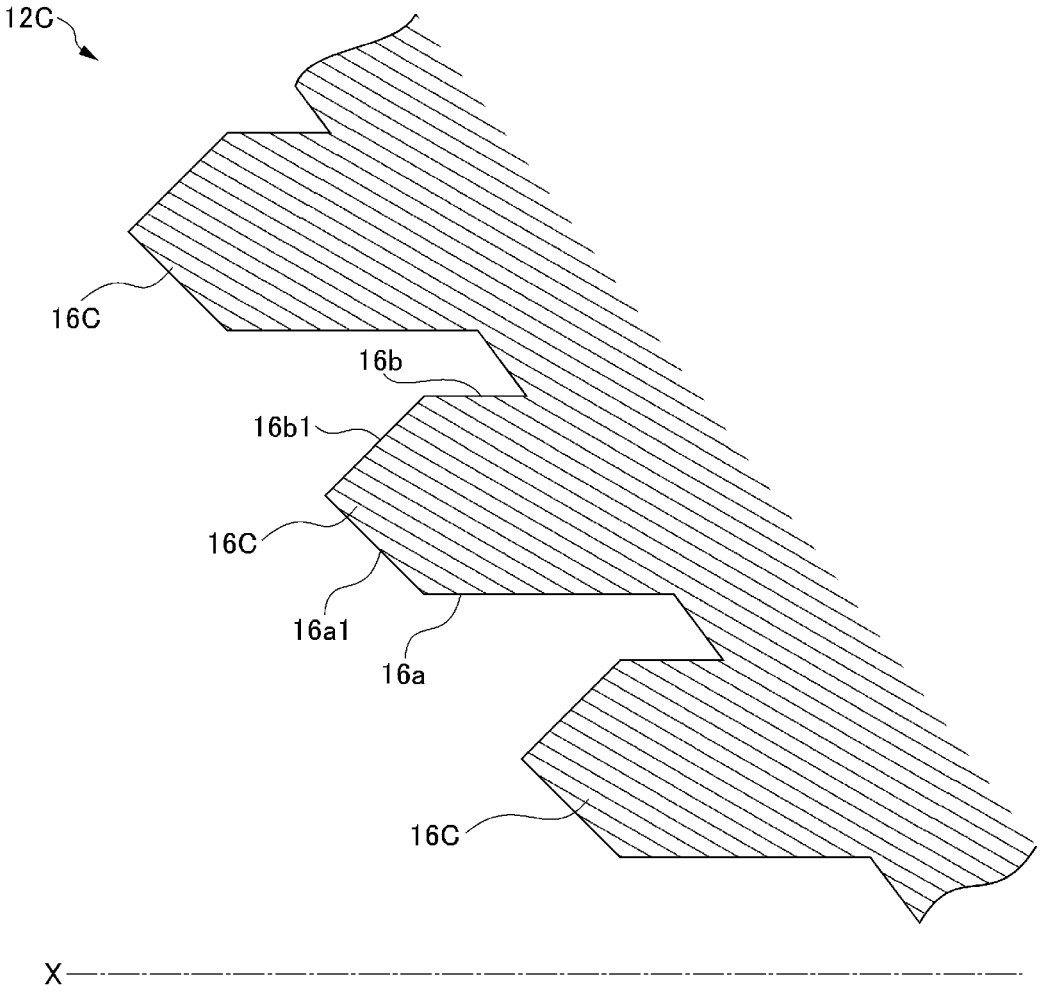
FIG. 10 is a diagram schematically showing a convex portion of a venturi nozzle according to a third modification of the present invention.

Further, in each of the above-described embodiments, among the surfaces constituting the grooves or ridges, the surfaces 16*a* faced to the central X-axis side of the nozzle portion and the surfaces 16*b* faced to the outer surface side of the nozzle portion 12B extend parallel or perpendicular to the central X-axis, but the present invention is not limited thereto. That is, as shown in FIG. 10, among the surfaces constituting the ridges 16C, each surface 16*a* faced to the central X-axis side of the nozzle portion 12C may have a surface 16*a*1 extending in a direction diverging from the central X-axis toward the upstream of the nozzle portion 12C. Further, among the surfaces constituting the ridges 16C, each surface 16*b* faced to the outer surface side of the nozzle portion 12C may have a surface 16*b*1 extending in a direction approaching to the central X-axis toward the upstream of the nozzle portion 12C.

By setting the grooves such that the angle formed between the surface constituting the groove and the central axis is a minor angle of 0 degrees or more, the grooves can be optimally formed when the nozzle portion is formed with a mold. Here, the angle formed between the surface constituting the groove and the central axis is defined by an angle formed when a straight line parallel to the central axis is aligned with the edge of a surface constituting a groove and facing to the inner surface side of the nozzle portion, and the angle is expressed as a positive angle with referring to the central axis (i.e., the start line).

Further, in the present embodiment, a plurality of ridges 16 formed annularly over the entire circumference are arranged at intervals in the flow direction of combustion air, but the present invention is not limited to this. That is, the grooves or the ridges may be formed on a portion of the inner surface of the nozzle portion. In this case, when the nozzle portion is viewed in the axial direction (i.e, when the nozzle section is viewed in the direction of combustion air flow), it is sufficient that adjacent grooves or ridges are disposed at superimposed positions. Further, the grooves or the ridges may be formed in a spiral shape on the inner surface of the nozzle portion. In other words, in the present specification, the wordings "a plurality of grooves or ridges arranged at predetermined intervals in the flow direction of combustion air" means that adjacent grooves or protrusions are arranged at overlapped positions when the nozzle portion is viewed in the axial direction.

Further, the fuel supply device may include a gas pressure adjusting mechanism for adjusting the pressure of fuel gas supplied to the venturi nozzle.

DESCRIPTION OF REFERENCE NUMERALS

1 venturi nozzle; 12 nozzle portion; 13 mixing portion; 15 fuel gas inlet; 16 ridge; 20 blower; 30 controller; 100 fuel supply device

What is claimed is:

1. A venturi nozzle, being disposed upstream from a blower, which is configured to mix combustion air and fuel gas by intake pressure of the blower, comprising:

a nozzle portion with a curved surface portion that is narrowed in diameter to downstream and is configured for the combustion air to be introduced;

a mixing portion, being disposed downstream from the nozzle portion, with a shape that is enlarged in diameter to downstream and is configured for the combustion air and the fuel gas to be mixed; and a fuel gas inlet disposed between the nozzle portion and the mixing portion and is configured for the fuel gas to be introduced, and a plurality of sets of predetermined turbulence-causing surfaces disposed along an inner surface of the convexly curved surface portion at a predetermined interval in a flow direction, and is configured to cause sufficient turbulence partially in the flow direction of the combustion air over the inner surface of the nozzle portion.

2. The venturi nozzle according to claim 1, wherein heights (h) of the surfaces are 0.5 mm to 5 mm, and wherein ratios (l/h) of distances (l) between adjacent ones of the surfaces to the heights (h) of the surfaces are within a range from 1 to 5.

3. The venturi nozzle according to claim 1, wherein, the surfaces constitute ridges, some of the surfaces faced to a central axis side extend parallel to a central axis or perpendicular to the central axis, or diverge from the central axis in an upstream direction, and wherein, others of the surfaces faced to an outer surface side of the nozzle portion extend parallel to the central axis or perpendicular to the central axis, or approach to the central axis in the upstream direction.

4. The venturi nozzle according to claim 1, wherein a ratio of a flow coefficient, when the Reynolds number is 1.0E+5, to a flow coefficient, when the Reynolds number is 2.5E+5, is 0.97-1.00.

5. The venturi nozzle according to claim 1, wherein a ratio of a flow coefficient, when the Reynolds number is 5.0E+4, to a flow coefficient, when the Reynolds number is 2.5E+5, is 0.94-1.00.

6. A fuel supply device for variably supplying fuel, comprising:

the venturi nozzle according to claim 1, a blower disposed downstream from the venturi nozzle, and a controller for controlling an output of the blower.

7. The venturi nozzle according to claim 1, wherein the plurality of the surfaces are formed as one of the group consisting of ribs, grooves and ridges.

8. The venturi nozzle according to claim 7, wherein some of the surfaces faced to a central axis side extend parallel to a central axis or perpendicular to the central axis, or diverge from the central axis in an upstream direction while others of the surfaces faced to an outer surface side of the nozzle portion extend parallel to the central axis or perpendicular to the central axis, or approach to the central axis in the upstream direction.

9. A venturi nozzle, being disposed upstream from a blower, which is configured to mix combustion air and fuel gas by intake pressure of the blower, comprising:

a nozzle portion with a shape that is narrowed in diameter to downstream and is configured for the combustion air to be introduced;

a mixing portion, being disposed downstream from the nozzle portion, with a shape that is enlarged in diameter to downstream and is configured for the combustion air and the fuel gas to be mixed; and a fuel gas inlet disposed between the nozzle portion and the mixing portion and is configured for the fuel gas to be introduced, and a plurality of surfaces forming grooves or ridges disposed along a convexly curved inner surface of the nozzle portion, which extend in a circumferential direction of the inner surface of the nozzle portion, and are arranged at predetermined intervals in a flow direction of the combustion air, wherein each of the grooves or ridges is parallel to a central axis or perpendicular to the central axis.

10. The venturi nozzle according to claim 9, wherein a top as formed by adjacent ones of the grooves is formed in a rib shape.

11. The venturi nozzle according to claim 9, wherein a top of each of the ridges is formed in a rib shape.

* * * * *